US007511728B2

(12) United States Patent
Braun et al.

(10) Patent No.: US 7,511,728 B2
(45) Date of Patent: Mar. 31, 2009

(54) MULTICOLORED THERMAL PRINTER, RIBBON AND MEDIA

(75) Inventors: John F. Braun, Fairfield, CT (US); Jay Reichelsheimer, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 194 days.

(21) Appl. No.: 11/541,278

(22) Filed: Sep. 30, 2006

(65) Prior Publication Data

US 2008/0079798 A1 Apr. 3, 2008

(51) Int. Cl.
*B41J 2/32* (2006.01)

(52) U.S. Cl. ..... 347/171

(58) Field of Classification Search ..... 347/222, 347/172, 173, 174, 175, 176, 171, 2; 346/134; 235/454

See application file for complete search history.

(56) References Cited

U.S. PATENT DOCUMENTS 5,264,873 A * 11/1993 Fiscella et al. ..... 346/134
6,025,860 A * 2/2000 Rosenfeld et al. ..... 347/171
6,203,131 B1 * 3/2001 Wiklof ..... 347/2
6,561,422 B1 * 5/2003 Cariffe ..... 235/454
7,045,178 B2 5/2006 Hardin et al.

* cited by examiner

*Primary Examiner*—K. Feggins
(74) *Attorney, Agent, or Firm*—George M. Macdonald; Angelo N. Chaclas

(57) ABSTRACT

Printing systems and methods are described for multicolored thermal printing simultaneously using a plurality of thermal printing technologies to achieve multicolored output. In one configuration, a dual thermal technology thermal printer includes a single thermal media ribbon printing subsystem using a multi-temperature thermal print head capable of producing grayscale or varying intensity marking on a multi-intensity direct contact thermal media such as a grayscale media.

13 Claims, 4 Drawing Sheets

MULTICOLORED THERMAL PRINTER, RIBBON AND MEDIA

FIELD OF THE INVENTION

The present invention relates to thermal printers and supplies and more particularly multicolored thermal printing systems and supplies for simultaneously using a plurality of thermal printing technologies to achieve multicolored output.

BACKGROUND OF THE INVENTION

There are two main competing thermal printing technologies used with media such as labels. Thermal ribbon transfer uses heat to transfer a wax based ink to a media producing relatively durable output. Direct thermal printers utilize a chemically coated paper that is marked by a chemical reaction in response to print head heat and that was widely used in previous generation facsimile machines and that has a relatively short output shelf life. Designers of thermal printing applications such as point of sale (POS) receipt applications and barcode printing applications typically consider the various advantages and disadvantages of each technology and select the appropriate technology for an application.

In the first technology, thermal ribbon transfer printers typically utilize a fixed width thermal print head. A rubber drive roller called a platen feeds a thermal transfer media stock passed the print head and a thin thermal transfer ribbon or foil is sandwiched between the print head and the media. The ribbon is typically a polyester film coated on the label side with a wax, wax-resin or pure resin ink. The ribbon is fed past the print head using a spooling mechanism having a source and uptake spool. Since the wax is designed to transfer at a single temperature, there has previously been no application for a multiple heat level thermal print head for use with thermal ribbon transfer printers. Multicolor thermal ribbon transfer printers are sometimes used for color label applications and have complicated media paths such as the CB-416-T3 Color Barcode Printer available from Toshiba TEC America of Atlanta, Ga. Similarly, a color thermal transfer printing process known as OPAL has been described by the Polaroid Corporation of Waltham, Mass.

In the second technology, direct thermal printers typically utilize a fixed width thermal print head. A rubber drive roller called a platen feeds a heat responsive direct thermal media stock passed the print head and the resistive heat elements are driven by the printer controller and element drivers to create the printed image. The media is typically a paper roll that is impregnated with a solid-state mixture of a dye and a suitable matrix. In a common POS receipt application, a monochromatic black media is utilized.

Certain dual color direct thermal printing systems have been developed that utilize relatively expensive dual color thermal media stock. For example, the TM-T88IV two-color direct thermal receipt printer is available from Epson America, Inc. of Long Beach, Calif. In such a system, the direct thermal media includes two different leuco dye reactions that occur at different temperatures. Accordingly, the printer will activate one temperature to print a fist color such as black and another temperature to print the second color such as blue. The colors available to such systems are limited by the availability of leuco dye chemistries for use in such media. Furthermore, the dual color direct thermal media may cost three times as much as a comparable roll of monochrome media. Conversely, thermal ribbon is available is virtually any color. There are also grayscale direct thermal systems available that are typically used in medical applications such as the Mitsubishi P-93W grayscale thermal printer Mitsubishi Digital Electronics America, Inc. of Irvine, Calif. Such systems utilize grayscale thermal media such as the Kanzaki KPT-1270 available from Kanzaki Specialty Papers of Springfield, Mass. that includes a leuco dye that is responsive to a range of heats to produce a range of gray scale intensities.

There are certain thermal printers that have been designed to alternatively operate in a direct thermal printing mode or a thermal ribbon transfer mode. For example, the CITIZEN CLP4081 thermal printer available from Citizen Systems Europe UK of Berkshire, United Kingdom can be configured to work in either a thermal transfer mode or a direct thermal transfer mode. It is of course possible that someone might have used direct thermal media stock in a thermal ribbon transfer printer instead of the typical thermal transfer stock. For example, the B700 thermal ribbon transfer postage meter available from Pitney Bowes Inc. of Stamford, Conn. utilizes a red thermal ribbon that transfers at about approximately in the range of 75 degrees Celsius. Such a printer might also mark a direct thermal media if it activates at the same temperature. However, the thermal transfer printer is a single heat monochromatic wax transfer technology. Even if the direct thermal media placed in that printer were to be activated at the temperature used by the thermal transfer printer, there would be no variance of the heat used to vary the color contribution of the direct thermal media.

Accordingly, there is a need for a multicolored thermal printer using relatively inexpensive thermal media. Additionally, there is a need to provide multicolored thermal printer using a single one-color thermal transfer ribbon.

SUMMARY

The illustrative embodiments of the present application describe multicolored thermal printing systems and supplies for simultaneously using a plurality of thermal printing technologies to achieve multicolored output. In one illustrative configuration, a dual thermal technology thermal printer includes a single thermal media ribbon printing subsystem using a multi-temperature thermal print head capable of producing grayscale or varying intensity marking on a multi-intensity direct contact thermal media such as a grayscale media.

In another illustrative configuration, a dual thermal technology thermal printer includes a first print head in the media path capable of multi-level heating to produce varying intensity markings on a direct thermal media such as a grayscale media. The printer also includes a single ribbon thermal media transfer printing subsystem downstream of the first print head including a single temperature print head for depositing the wax based ink on the media (alternatively, the single temperature may be changed by configuration). Several additional illustrative configurations are described below.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The illustrative embodiments of the present application describe multicolored thermal printing systems and supplies for simultaneously using a plurality of thermal printing technologies to achieve multicolored output. The illustrative embodiments described solve the problem of lack of color options for thermal printing by combining two thermal technologies. The systems combine thermal transfer technology, which melts a colored ribbon material onto a substrate using a thermal print head, with direct thermal printing technology, which applies heat from a thermal print head directly to a special substrate which gets marked when heat is applied. Since traditional thermal transfer printers use a single color thermal ribbon, the resulting image can only be a single color. The second technology, which is used in many popular label printers, is to use a thermal print head, without a ribbon, but rather with a special substrate which is sensitive to heat.

The illustrative systems combining the use of a thermal ribbon with a substrate sensitive to heat, so that both the color of the ribbon and the color of the substrate can be combined, resulting in more than one color. One of the advantages of the system is that with a single color ribbon and grayscale thermal media, more than a single color can be created. The illustrative embodiments utilize a grayscale to black multiple intensity direct thermal media with a single color thermal transfer ribbon (fluorescent red ribbon used in postage applications is described, but any color other than the media color, here black, should be acceptable). As can be appreciated, different combinations of colors may be utilized.

Figure 1:
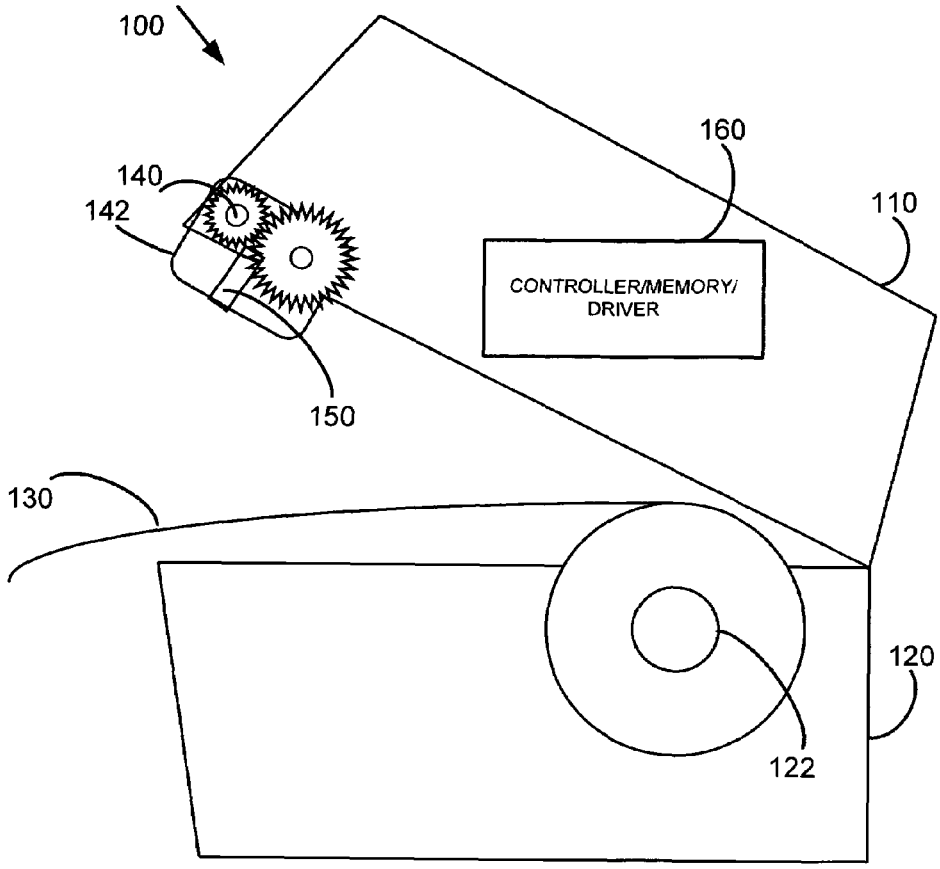
FIG. 1 is a left side cutaway view of a dual technology multicolor thermal printer according to an illustrative embodiment of the present application.

Referring to FIG. 1, a left side cutaway view of a dual technology multicolor thermal printer 100 according to an illustrative embodiment of the present application is shown. The printer 100 is configured in a clamshell design, but alternatively other configurations may be used. The bottom portion of the clamshell 120 includes the media roller 122 and contains the direct thermal media roll 130. The media transport mechanisms such as appropriate rollers, nips and platen are not shown for purposes of clarity, but are known to one of skill in the art. The upper half of the clamshell 110 includes the controlling circuitry such as the Controller/Memory/Thermal Element Driver circuitry 160. Additionally, in this configuration, the upper clamshell half 110 houses the multi-temperature thermal print head 150 and the thermal transfer technology ribbon spooling mechanism 140 used for the thermal transfer ribbon 142.

Alternatively, a single heat thermal print head with a configurable temperature level could be used. Similarly, sheet fed or other known media transports may be utilized. Additionally, many appropriate controllers, memory and thermal element drivers are available or may be configured for the design to operate as described herein. The media may include a roll of media and alternatively can include a roll of adhesive backed thermal label stock.

Figure 2:
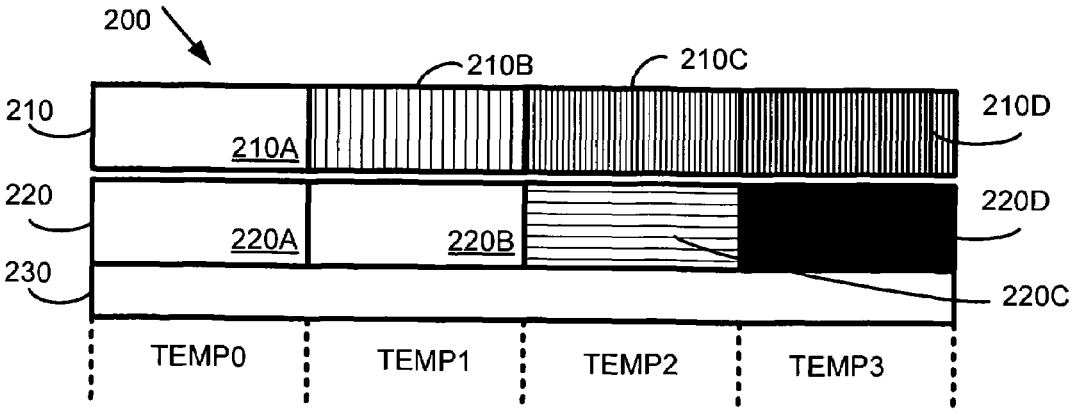
FIG. 2 is a schematic diagram of a thermal media according to an illustrative embodiment of the present application for use with the printer of FIG. 1.

Referring to FIG. 2, a schematic diagram of a thermal media 200 according to an illustrative embodiment of the present application is shown for use with the printer 100 described above with reference to FIG. 1. Thermal media is designed to operate or activate at one or more temperatures. The wax ink of a thermal ribbon is designed to be deposited at a certain print head temperature. The direct media and thermal ribbon characteristics can then be selected as appropriate for an application. Accordingly, several combinations are possible with a single multi-temperature print head as described here.

In this illustrative embodiment, there will be different temperatures at which certain events occur. For example at a first lowest relevant temperature TEMP0, the thermal ribbon wax ink will not transfer to the media and the direct thermal portion of the media will not be marked. The next relevant temperature is TEMP1. At temperature TEMP1, the thermal ribbon material will melt onto the substrate. Below temperature TEMP1, the ribbon material will not transfer to the substrate. Assuming a red ribbon, the resulting color would be Red at TEMP1. The next relevant temperature point described is referred to as TEMP2. This temperature, which is larger than TEMP1, will not only transfer the ribbon material to the substrate, but will also darken the substrate at a 50% gray level. The resulting color will be a combination of the ribbon material, and the 50% darkness of the thermal media. Assuming a red ribbon and media that turns grey when exposed to heat of temperature TEMP2, the resulting color would be a Medium Red. The final relevant temperature point described is referred to as TEMP3. This temperature, which is larger than both TEMP1 and TEMP2, will not only transfer the ribbon material to the substrate, but will also darken the substrate at a 100% level or black. The resulting color will be a combination of the ribbon material, and the 100% darkness of the thermal media. Assuming a red ribbon and media that turns black when exposed to the heat of temperature TEMP3, the resulting color would be a Dark Red.

The printed media 200 reflects the levels described above. The thermal media has a base of the substrate 230, a direct thermal marking layer 220 that is white and is marked in grayscale. The top layer represents deposited wax ink 210 from a thermal ribbon that is red in this case. In this example, the deposited wax ink is red, but the colors depicted reflect the colors as seen from the top of the media after the direct thermal layer is marked and after the wax ink layer is deposited. Accordingly, the section 210A represents no deposited ink over an unmarked direct media section 220A for a resulting color of the unmarked substrate or in this case white. Section 210B represents deposited ink over unmarked direct media section 220B creating a light red color in this case. Similarly, section 210C represents deposited ink over a 50% gray marked direct media section 220C creating a medium red color in this case. Finally, section 210D represents deposited ink over a 100% marked black direct media section 220D creating a dark red color in this case.

Figure 3:
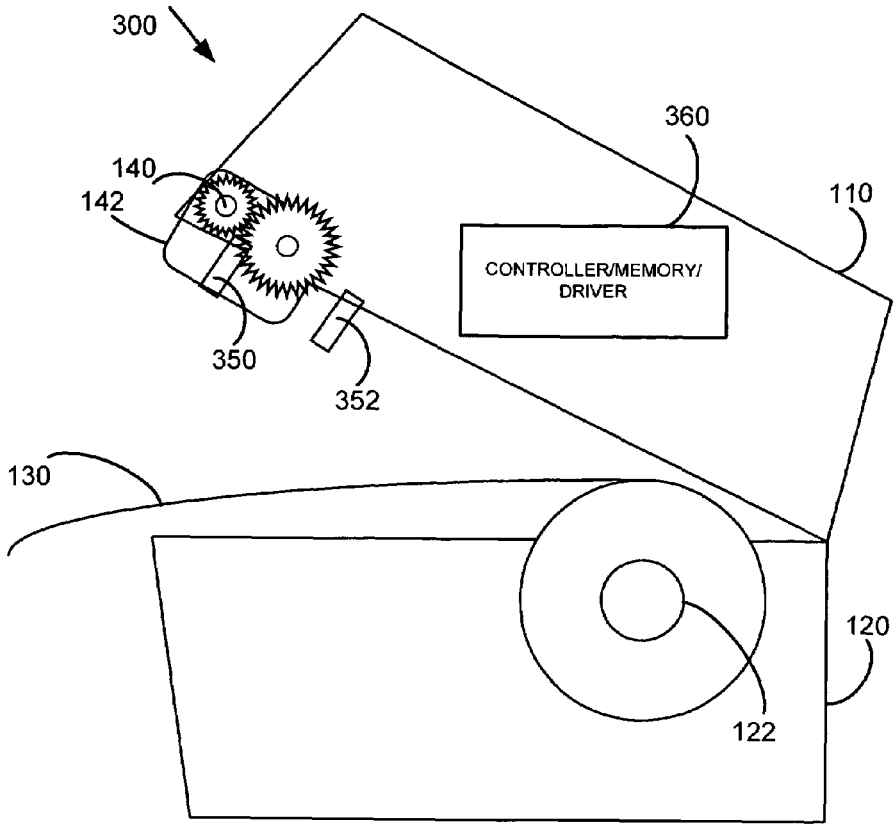
FIG. 3 is a left side cutaway view of a dual print head, dual technology multicolor thermal printer according to an illustrative embodiment of the present application.

Referring to FIG. 3, a left side cutaway view of a dual print head, dual technology multicolor thermal printer 300 according to an illustrative embodiment of the present application is shown. Many of the components are similar to those of printer 100 and the description is not repeated here. In this illustrative embodiment, a first print head H1 352 is placed upstream of the thermal ribbon print head 350. The first print head 352 is a multi-temperature print head that is capable of grayscale printing. The second print head 350 H2 is a more traditional single temperature thermal transfer print head with ribbon assembly 140. The Controller/Memory/Thermal Element Driver circuitry 360 is configured to operate the two print head to create thermal media such as that shown in FIG. 4.

Figure 4:
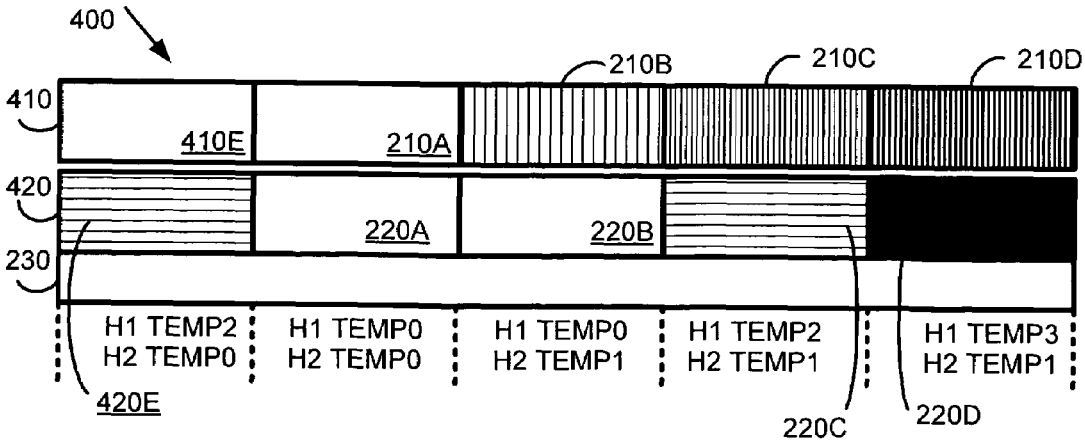
FIG. 4 is a schematic diagram of a thermal media according to an illustrative embodiment of the present application for use with the printer of FIG. 3.

Referring to FIG. 4, a schematic diagram of a thermal media 400 according to an illustrative embodiment of the present application for use with thermal printer 300 is shown. Many of the components are similar to those of media 200 and the description is not repeated here. The lower layer 420 represents a multi-intensity direct thermal media such as a grayscale direct thermal media that is marked by the first print head 352 H1 in a range of temperatures from TEMP0 through TEMP3. The top layer represents deposited wax ink 410 from a red thermal ribbon that is deposited by the second print head 350 H2 that operates in a heat element off mode TEMP0 or an on temperature TEMP1 that deposits the ink. Accordingly, the section 410E represents no deposited ink over a 50% grayscale marked direct media section 420E for a resulting color of 50% gray.

Figure 5:
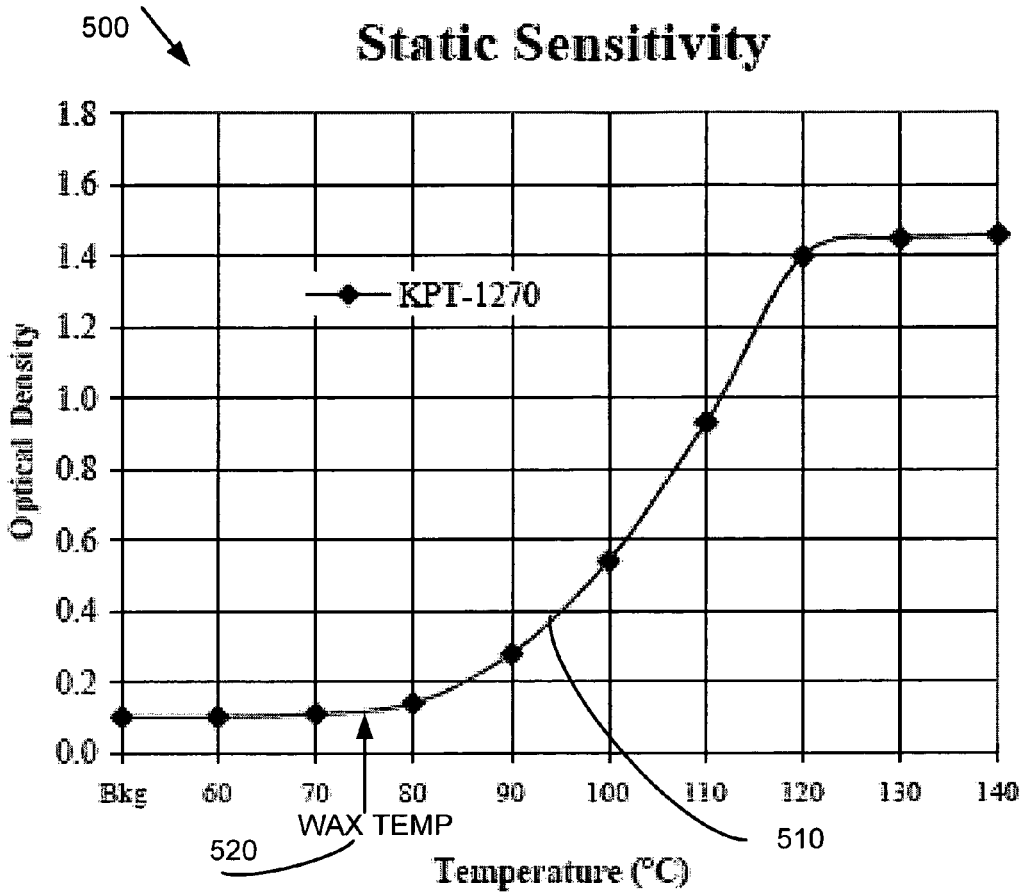
FIG. 5 is a diagram of media response to varying heat applied by a thermal print head according to an illustrative embodiment of the present application.

Referring to FIG. 5, a diagram 500 of media response to varying heat applied by a thermal print head according to an illustrative embodiment of the present application is shown that can be used with printer 100. Thermal media response curve 510 shows the grayscale response versus temperature. The ribbon is selected and the head is configured to deposit wax at Wax Temperature 520 so that wax can be deposited on a largely unmarked portion of media.

Figure 6:
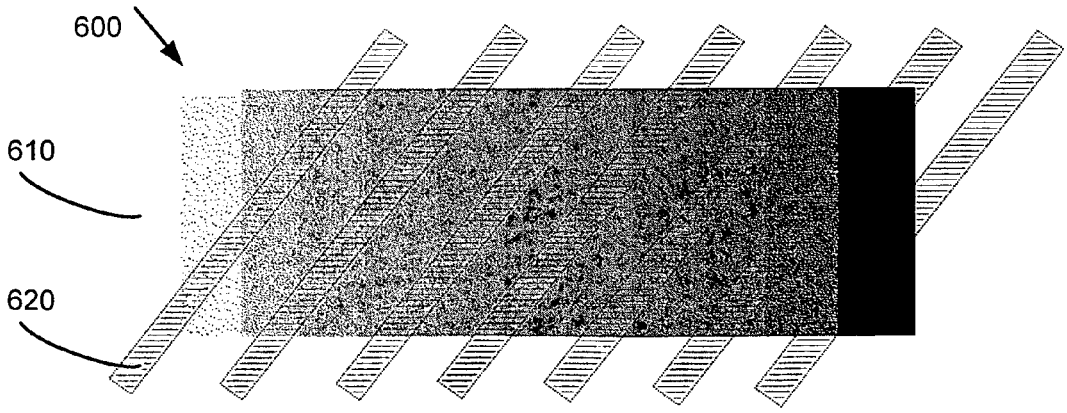
FIG. 6 is a diagram of multicolored thermal media output as processed accruing to an illustrative embodiment of the present application.

Referring to FIG. 6, a diagram of multicolored thermal media output as processed accruing to an illustrative embodiment of the present application is shown. The figure is representative of a test completed in two passes to simulate a multi-level thermal ribbon print head. A sample of K1270 media was printed using a Mitsubishi P-91 grayscale printer to print in a first pass on the direct thermal media bands of successively darkening regions from very light gray through black. Then, the media was fed through a test bed B700 postage meter printing mechanism that operates at approximately over 75 degrees Celsius in order to print diagonal lines of fluorescent red postage ink dots. The sample reflectance measured as shown in TABLE 1.

TABLE 1

| Filter A Paper - % | Filter A Ink - % | Filter C Paper - % | Filter C Ink - % | Filter E Paper - % | Filter E Ink - % |
|---|---|---|---|---|---|
| 82 | 22 | 88 | 86 | 89 | 86 |
| 53 | 14 | 66 | 62 | 66 | 65 |
| 46 | 13 | 54 | 48 | 52 | 51 |
| 35 | 12 | 44 | 43 | 40 | 40 |
| 24 | 7 | 33 | 40 | 35 | 33 |
| 16 | 5 | 23 | 22 | 25 | 22 |
| 10 | 4 | 14 | 15 | 18 | 16 |
| 5 | 2 | 6 | 7 | 7 | 7 |
| 4 | 2 | 6 | 5 | 5 | 5 |

The A MacBeth filter applied was a Green/Blue filter, the C filter applied was Visible and the E filter applied was Red Laser.

Figure 7:
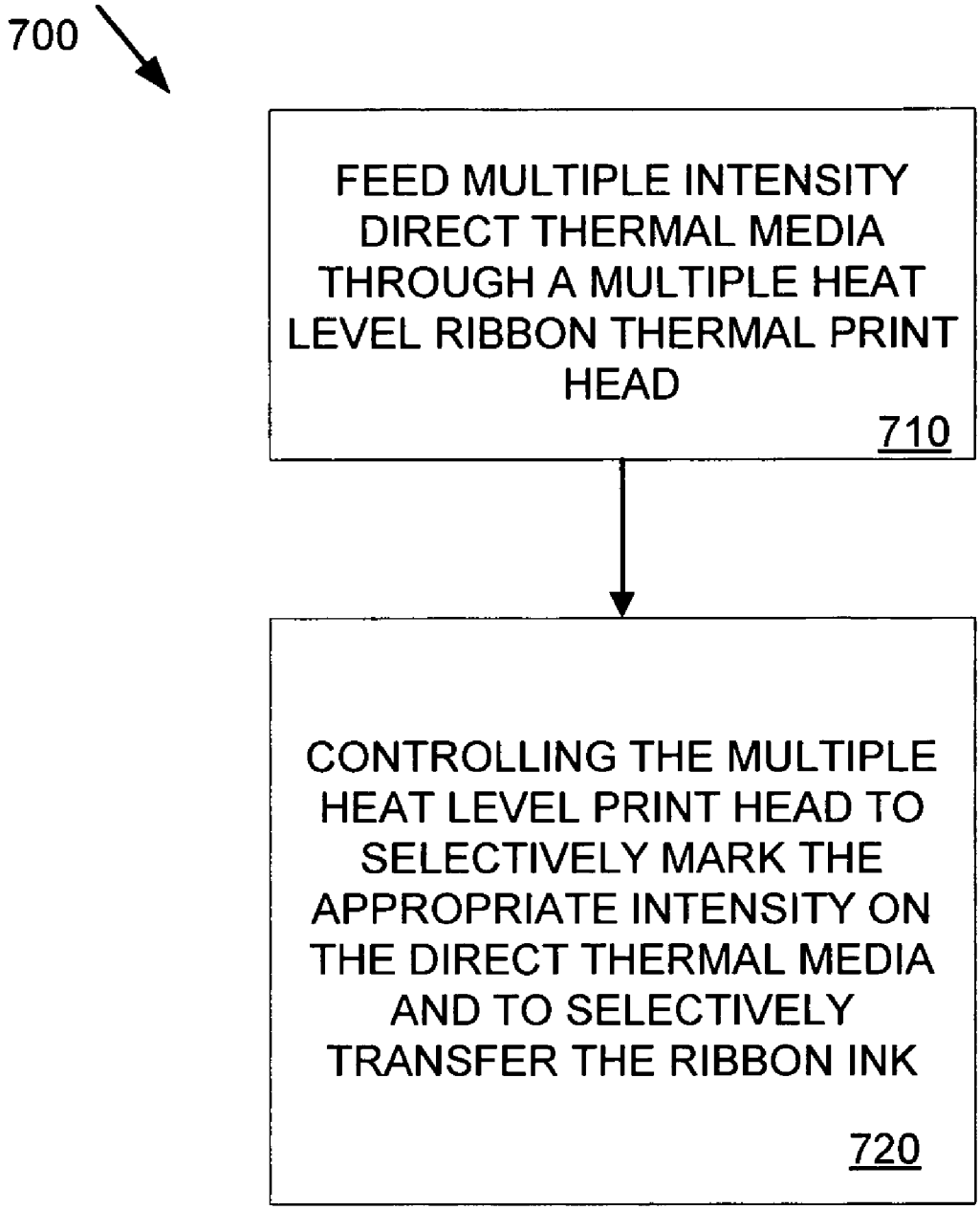
FIG. 7 is a flowchart showing an illustrative process for operating a dual thermal technology printer according to an illustrative embodiment of the present application.

Referring to FIG. 7, a flowchart showing an illustrative process 700 for operating a dual thermal technology printer according to an illustrative embodiment of the present application is shown. In step 710, the system feeds multiple intensity direct thermal media through a multiple heat level ribbon thermal print head. The media can be fed by loading a roll of media onto a spool and operating the printer or by feeding other media formats such as sheets or labels into the printer. In step 720, the system controls the multiple heat level print head to selectively mark the appropriate intensity on the direct thermal media and to selectively transfer the ribbon ink. A user may set the controls on the printer or may use an application program to send print commands to the printer through a printer driver.

While several embodiments of the invention have been described and illustrated above, it should be understood that these are exemplary of the invention and are not to be considered as limiting. Additions, deletions, substitutions, and other modifications can be made without departing from the spirit or scope of the present invention. For example, other known colors, media, print heads and media transports may be substituted for those described above. Accordingly, the invention is not to be considered as limited by the foregoing description but is only limited by the scope of the appended claims.

What is claimed is:

1. A dual technology thermal printer comprising:

a printer housing containing a thermal print head controller and a thermal print head operatively connected to the controller;

the printer housing containing a feeding subsystem for feeding direct thermal media past the thermal print head;

a thermal transfer ribbon spooling subsystem operatively connected to the printer housing for feeding a thermal transfer ribbon between the thermal print head and the direct thermal media, wherein the thermal transfer ribbon comprises an ink that is deposited at a temperature lower than a substantial activation temperature associated with the direct thermal media.

2. The printer of claim 1 wherein the thermal print head comprises a multi-heat-level thermal print head capable of printing grayscale direct thermal media.

3. The printer of claim 2 wherein the direct thermal media is a roll of grayscale media.

4. The printer of claim 1 wherein the thermal transfer ribbon comprises a fluorescent red ink.

5. A dual technology thermal printer comprising:

a printer housing containing a thermal print head controller, a first thermal print configured to mark media operatively connected to the controller and a second thermal print head configured to mark media operatively connected to the controller;

the printer housing containing a feeding subsystem for feeding direct thermal media first past the first thermal print head and then past the second thermal print head;

a thermal transfer ribbon spooling subsystem operatively connected to the printer housing for feeding a thermal transfer ribbon between the second thermal print head and the direct thermal media, wherein, the thermal transfer ribbon comprises an ink that is deposited at a temperature lower than a substantial activation temperature associated with the direct thermal media.

6. The printer of claim 5 wherein the first thermal print head comprises a multi-heat-level thermal print head capable of printing grayscale direct thermal media.

7. The printer of claim 6 wherein the second thermal print head comprises a single-heat-level thermal print head capable of depositing ink from the thermal transfer ribbon.

8. The printer of claim 6 wherein the direct thermal media is a roll of grayscale media.

9. The printer of claim 5 wherein the thermal transfer ribbon comprises a fluorescent red ink.

10. The printer of claim 5 wherein the controller is configured to control the first multi-heat-level thermal print head and the second single-heat-level thermal print head.

11. A method for printing using a dual technology thermal printer comprising:

feeding multiple intensity direct thermal media through the dual technology thermal printer having at least one multiple heat level ribbon thermal print head and single color thermal ribbon; and controlling the at least one multiple heat level print head to selectively mark the appropriate intensity on the direct thermal media and to selectively transfer the ribbon ink, wherein, controlling the at least one multiple heat level print head comprises simultaneously selectively marking the appropriate intensity on the direct thermal media and selectively transferring the ribbon ink.

12. The method of claim 11 wherein the multiple heat level ribbon thermal print head may be driven at a temperature that causes ink from the thermal ribbon to transfer without appreciably marking the multiple intensity direct thermal media.

13. The method of claim 11 wherein the multiple intensity direct thermal media is fed from a roll of thermal media label stock.

* * * * *